US008829321B2

(12) United States Patent
Klein

(10) Patent No.: US 8,829,321 B2
(45) Date of Patent: Sep. 9, 2014

(54) PERCUSSION INSTRUMENT

(71) Applicant: Pascal Klein, Leutenheim (FR)

(72) Inventor: Pascal Klein, Leutenheim (FR)

( * ) Notice: Subject to any disclaimer, the term of this patent is extended or adjusted under 35 U.S.C. 154(b) by 0 days.

(21) Appl. No.: 13/940,910

(22) Filed: Jul. 12, 2013

(65) Prior Publication Data

US 2014/0000436 A1 Jan. 2, 2014

Related U.S. Application Data

(63) Continuation of application No. 13/256,103, filed on Sep. 12, 2011, now Pat. No. 8,487,170.

(30) Foreign Application Priority Data

Mar. 13, 2009 (FR) ..... 09 01165

(51) Int. Cl.
*G10D 13/02* (2006.01)

(52) U.S. Cl.
CPC ..... *G10D 13/025* (2013.01); *G10D 13/02* (2013.01)
USPC ..... 84/411 R

(58) Field of Classification Search
USPC ..... 84/411 R
See application file for complete search history.

(56) References Cited

U.S. PATENT DOCUMENTS

| | | | | | |
|---|---|---|---|---|---|
| 2,495,495 | A * | 1/1950 | Adler | 84/411 R |
| 3,215,021 | A * | 11/1965 | Kester, Jr. | 84/411 R |
| D212,172 | S * | 9/1968 | Lewis | D17/22 |
| 3,680,423 | A * | 8/1972 | Lander | 84/170 |
| 3,705,527 | A * | 12/1972 | Burnham | 84/403 |
| 4,026,185 | A * | 5/1977 | Migirian | 84/411 R |
| 4,137,815 | A * | 2/1979 | Kloc | 84/408 |
| 4,256,006 | A * | 3/1981 | Widener | 84/411 R |
| 5,385,075 | A * | 1/1995 | Carnes et al. | 84/411 R |
| 6,700,044 | B1 * | 3/2004 | Bencomo, Jr. | 84/411 R |
| 7,601,901 | B2 * | 10/2009 | Payerl | 84/411 R |
| 8,008,560 | B2 * | 8/2011 | Wiese et al. | 84/411 R |
| 8,115,088 | B2 * | 2/2012 | Herrera | 84/411 R |
| 8,481,834 | B2 * | 7/2013 | Eduardo | 84/411 R |
| 8,487,170 | B2 * | 7/2013 | Klein | 84/411 R |
| 2013/0180382 | A1 * | 7/2013 | Buchner | 84/411 R |

OTHER PUBLICATIONS

Boombakini by Felle Vega, uploaded on Mar. 7, 2007, viewed at http://www.youtube.com/watch?v=MscN4Xc-IEU on Nov. 13, 2012.*

* cited by examiner

*Primary Examiner* — Robert W Horn
(74) *Attorney, Agent, or Firm* — McGlew and Tuttle, P.C.

(57) ABSTRACT

A percussion instrument of the type having a box composed of four walls (1) forming the outline, on which a top (2) rests, the lateral end walls (3-4) having a rectangular profile, the front (5) and rear (6) faces having a convex profile (7) in their lower part while in their upper part on which the top rests they follow a line which is firstly rectilinear (8), then continued by a concave part (9), which is itself continued by a rectilinear or very slightly convex part (10), such that the box is divided into three zones: a deep zone (8) for producing bass sounds, continued by a shallower median part (9) for producing middle register sounds, the median part itself being continued in such a way as to form a chamber (10) which is slightly deeper than the median part for producing high pitched sounds, the chamber (10) producing the high pitched sounds being provided with a snare (17) lying against the top.

17 Claims, 4 Drawing Sheets

PERCUSSION INSTRUMENT

CROSS REFERENCE TO RELATED APPLICATIONS

This is a continuation under 37 CFR 1.53(b) of pending prior application Ser. No. 13/256,103 filed Sep. 12, 2011, which is a United States National Phase application of International Application PCT/FR2010/000183 filed Mar. 2, 2010 and claims the benefit of priority under 35 U.S.C. §119 of French Patent Application FR 09 01165 filed Mar. 13, 2009, the entire contents of each of the applications are incorporated herein by reference.

FIELD OF THE INVENTION

The invention relates to a percussion instrument. Instruments of the same family are the cajón from Peru and the Boombakini from the Dominican Republic.

BACKGROUND OF THE INVENTION

The cajón consists of a parallelepipedal wooden box with a hole at the back. This instrument stands directly on the ground with the musician sitting on it. The cajón is provided with a snare system formed of one or more metal wires. These metal wires are fixed to upper and lower parts of the box, crossing the latter and pressing against the striking surface. This wire may be straight or in a more expensive cajón it may take the form of a spiral.

The drawback of the cajón is that it has a limited range of sounds owing to its parallelepipedal shape. Furthermore, whichever part is struck, the snare vibrates. The cajón is not very comfortable to use because the musician strikes at a low level, which may cause back pain.

The Boombakini is a wooden instrument of a particular shape. It consists of a bottomless box. This box is composed of four faces forming the outline, on which a top rests. The lateral end walls have a rectangular profile. The front and rear faces have a convex profile in their lower part whilst in their upper part they follow a line which is firstly rectilinear, then continued by a concave part, which is itself continued by a rectilinear or very slightly convex part. The box may thus be divided into three zones: a deep zone for producing bass sounds, continued by a shallower median part for producing middle register sounds, said median part itself being continued in such a way as to form a chamber which is slightly deeper than the median part for producing high pitched sounds. A soundhole is arranged in the front face of the box. Although the Boombakini has a wider range of tones than the cajón, it has the drawback of having no snare. The bass sounds are dry and not round like those of a bass drum. Likewise the slap sound located at the slender high part cannot compare with a snare drum.

SUMMARY OF THE INVENTION

The device according to the invention makes it possible to remedy the drawbacks mentioned above.

Taking its inspiration from the shape of the Boombakini, a snare system has been added using two ferrous wires in the form of stretched-out springs which cross one another. This system is fixed in the slender, high pitched zone, on either side of the width thereof, and cross in the middle. This crossed system makes it possible to aim for the point on the striking surface where the impact will activate the snare. These wires are fixed so as to touch the cover of the box where it is struck and stay lying thereagainst. In this way, when the player strikes the deep part of the instrument to produce a low sound, the snare does not vibrate.

The deeper part then emits a sound similar to the bass drum and the slender part will emit a sound similar to the snare drum with vibration of the snare. To give intensity and 30 body to the sounds, a bottom was arranged over the entire lower part of the underside, closing the instrument entirely.

This bottom comprises one to two holes depending on the desired bass compression. This bottom is fixed to the box with the assistance of a plurality of reinforcements on the frame parts in the interior thereof. The entire box is made of wood.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
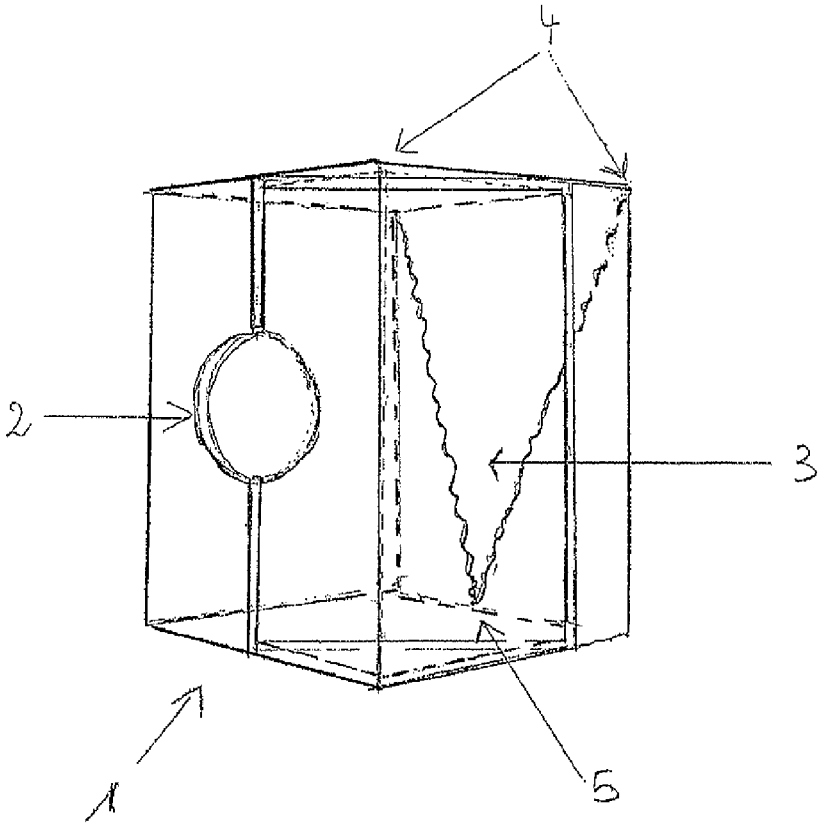
FIG. 1 is a perspective view of a cajón.

Referring to the drawings in particular, as shown in FIG. 1, a cajón consists of a parallelepipedal wooden box (1) provided with a hole (2) in the back. This instrument stands directly on the ground with the musician sitting on it. The cajón is provided with a snare system formed of one or more metal wires (3). The upper part of these metal wires is fixed to the top of the front face (4) and the lower part in the middle (5) of the edge of said front face such that they cross over the latter while pressing against the striking surface. This wire may be straight or in a more expensive cajón it may take the form of a spiral.

Figure 2:
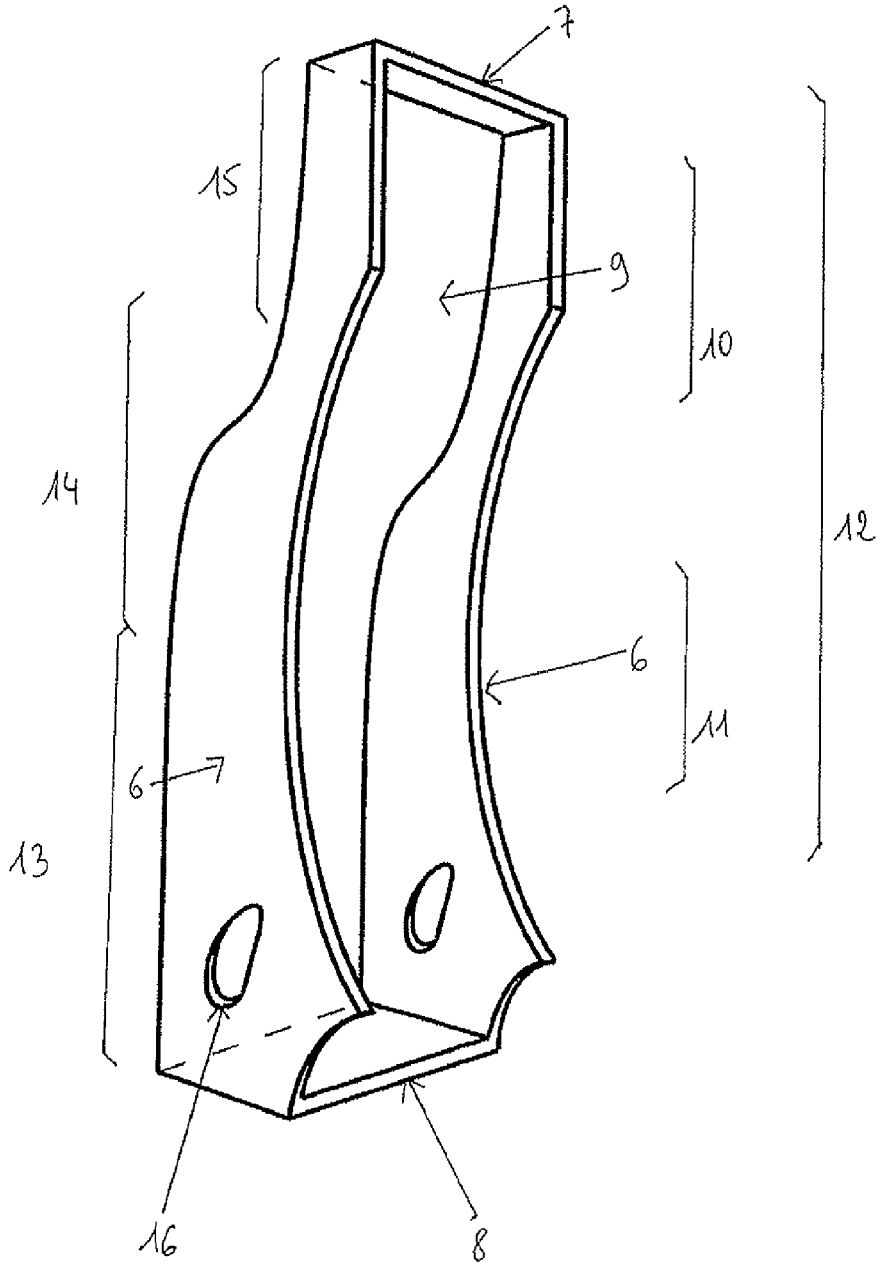
FIG. 2 is a perspective view of a Boombakini.
Figure 3:
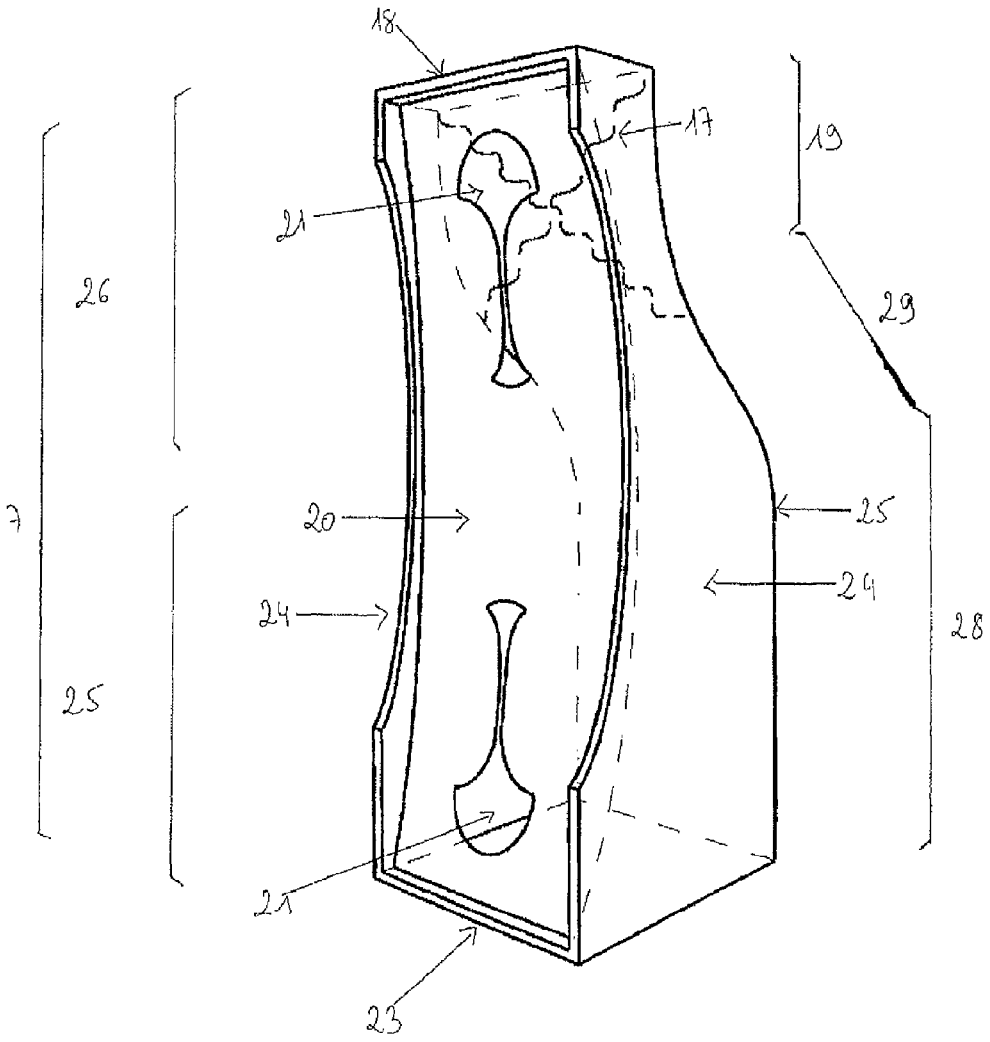
FIG. 3 is a perspective view of the invention.
Figure 4:
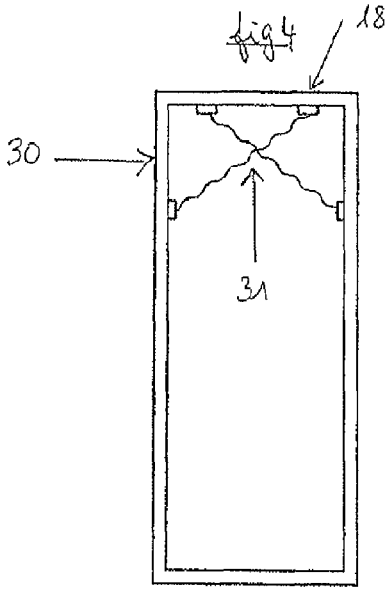
FIG. 4 is a view of the arrangement of the crossed stretched-out spring wires (snare) with fastening points.
Figure 5:
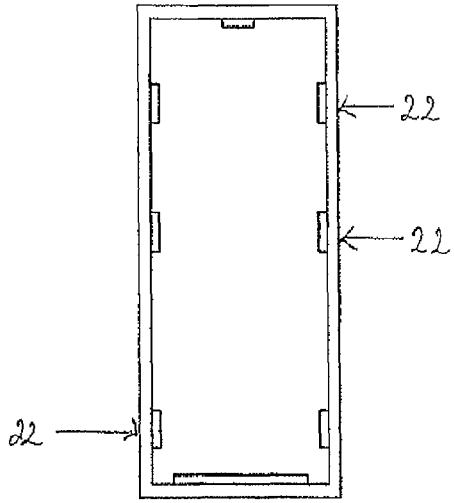
FIG. 5 is a view of the arrangement of the reinforcements inside the box.
Figure 6:
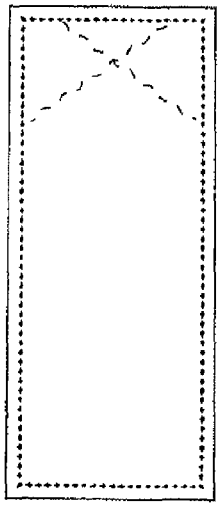
FIG. 6 is a view of the cover where the player strikes.
Figure 7:
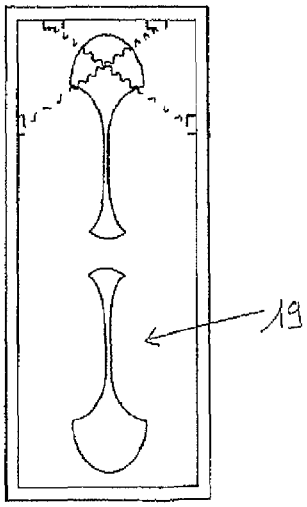
FIG. 7 is a view of the bottom with soundholes.

As shown in FIG. 2, a Boombakini consists of a bottomless box. This box is composed of four faces (6, 7 and 8) forming the outline, on which a top (9) rests. The lateral end walls (7 and 8) have a rectangular profile. The front (10) and rear (11) have a convex profile (12) in their lower part whilst in their upper part they follow a line which is firstly rectilinear (13), then continued by a concave part (14), which is itself continued by a rectilinear or very slightly convex part (15). The box may thus be divided into three zones: a deep zone (13) for producing bass sounds, continued by a shallower median part (14) for producing middle register sounds, said median part itself being continued in such a way as to form a chamber (15) which is slightly deeper than the median part for producing high pitched sounds. A soundhole (16) is arranged in the front face of the box.

As shown in FIGS. 3 to 7, the instrument to which the present application relates takes its inspiration from the shape of the Boombakini. A snare has been added which consists of two metal wires (17) in the form of stretched-out springs which cross one another. This snare is fixed in the slender high pitched zone. This crossed snare makes it possible to aim for the point on the striking surface where the impact will activate the snare. These wires in the form of springs are fixed on the one hand to the end wall (18) closing the chamber (19) and on the other hand to the front and rear faces at the entry to the chamber (19) such that they touch the top of the box where it is struck and stay lying against said top. In this way, when the player strikes on the deep part of the instrument to produce a low sound, the snare does not vibrate. The deeper part then emits a sound similar to the bass drum and the slender part will emit a sound similar to the snare drum with vibration of the snare. To give intensity and body to the sounds, a bottom (20) has been arranged over the entire lower part of the underside, closing the instrument entirely. This bottom comprises one to two soundholes (21) depending on the desired bass compression. This bottom is fixed to the box with the assistance of a plurality of reinforcements (22) on the peripheral frame parts in the interior thereof. The entire box is made of wood.

While specific embodiments of the invention have been shown and described in detail to illustrate the application of the principles of the invention, it will be understood that the invention may be embodied otherwise without departing from such principles.

What is claimed is:

1. A musical instrument, comprising:

a box comprising an arcuate bottom and four walls forming an outline, on which a top rests, the lateral end walls having a rectangular profile, wherein front and rear faces having a convex profile in a lower part and in an upper part on which the top rests follow a line which is firstly rectilinear, then continued by a concave part, which is continued by a rectilinear or very slightly convex part, such that the box is divided into three zones: a deep zone for producing bass sounds, continued by a shallower median part for producing middle register sounds, said median part being continued in such a way as to form a chamber which is slightly deeper than the median part for producing high pitched sounds, said chamber producing the high pitched sounds.

2. A musical instrument in accordance with claim 1, wherein said arcuate bottom rests, in the lower part of said convex profile of the front and rear faces, on reinforcements arranged around an internal periphery of said first side surface, said second side surface, said third side surface and said fourth side surface.

3. A musical instrument in accordance with claim 1, further comprising:

a snare arranged in said chamber, wherein the arcuate bottom is provided with soundholes, one of said soundholes being located opposite said snare.

4. A musical instrument in accordance with claim 2, wherein the arcuate bottom is provided with soundholes.

5. A musical instrument, comprising:

a box comprising a top surface, a bottom surface, a first side surface, a second side surface, a third side surface and a fourth side surface, said bottom surface comprising an arcuate shape, said first side surface, said second side surface, said third side surface and said fourth side surface supporting said top surface, said bottom surface being connected to said first side surface, said second side surface, said third side surface and said fourth side surface, said first side surface and said third side surface having a rectangular profile, said second side surface and said fourth side surface having a lower part and an upper part, said lower part comprising a convex profile, said upper part comprising an upper part profile, said upper part profile being rectilinear, then continued by a concave part, which is continued by a rectilinear or very slightly convex part, wherein said box comprises a deep zone for producing bass sounds, a shallower median part for producing middle register sounds and a chamber which is slightly deeper than the median part for producing high pitched sounds.

6. A musical instrument in accordance with claim 5, wherein said chamber is adjacent to said shallower median part.

7. A musical instrument in accordance with claim 6, wherein said bottom surface is supported on reinforcements arranged around an internal periphery of said first side surface, said second side surface, said third side surface and said fourth side surface.

8. A musical instrument in accordance with claim 5, wherein the bottom surface is provided with soundholes.

9. A musical instrument in accordance with claim 7, further comprising:

a snare, at least a portion of said snare being arranged in said chamber, wherein the bottom surface is provided with soundholes, at least a portion of one of said soundholes being located opposite said snare.

10. A musical instrument in accordance with claim 5, wherein said bottom surface is adjacent to said first side surface, said second side surface, said third side surface and said fourth side surface.

11. A musical instrument, comprising:

a first side wall;

a second side wall;

a third side wall;

a fourth side wall;

a top surface; and a bottom surface comprising a curved portion, said first side wall, said second side wall, said third side wall, said fourth side wall being connected to said top surface and said bottom surface, wherein said first side wall, said second side wall, said third side wall and said fourth side wall, said top surface and said bottom surface define a box structure, said first side wall and said third side wall having a rectangular contour, said second side wall and said fourth side wall having a lower part and an upper part, said lower part comprising a convex contour, said upper part comprising an upper part profile, said upper part profile comprising a rectilinear contour, a concave part and another rectilinear or very slightly convex portion, wherein said box structure comprises a deep zone for producing bass sounds, a shallower median part for producing middle register sounds and a chamber which is deeper than the median part for producing high pitched sounds.

12. A musical instrument in accordance with claim 11, wherein said chamber is adjacent to said shallower median part.

13. A musical instrument in accordance with claim 12, wherein said bottom surface is supported on reinforcements arranged around an internal periphery of said first side wall, said second side wall, said third side wall and said fourth side wall.

14. A musical instrument in accordance with claim 11, further comprising:

a snare arranged in said chamber, wherein the bottom surface is provided with soundholes, one of said soundholes being located opposite said snare.

15. A musical instrument in accordance with claim 13, wherein the bottom surface is provided with soundholes.

16. A musical instrument in accordance with claim 11, wherein said bottom surface is adjacent to said first side wall, said second side wall, said third side wall and said fourth side wall.

17. A musical instrument in accordance with claim 11, wherein said rectilinear contour is adjacent to said concave part, said concave part being adjacent to said another rectilinear or very slightly convex portion.

* * * * *